US012667793B2

(12) United States Patent
Collins et al.

(10) Patent No.: US 12,667,793 B2
(45) Date of Patent: Jun. 30, 2026

(54) MODEL VEHICLE VERTICAL DRIVE SYSTEM

(71) Applicant: TRAXXAS, L.P., McKinney, TX (US)

(72) Inventors: Trent Collins, McKinney, TX (US); Randy Perez, McKinney, TX (US); Otto Karl Allmendinger, Rowlett, TX (US); Adam Cole Ewing, McKinney, TX (US)

(73) Assignee: TRAXXAS, L.P., McKinney, TX (US)

( * ) Notice: Subject to any disclaimer, the term of this patent is extended or adjusted under 35 U.S.C. 154(b) by 198 days.

(21) Appl. No.: 18/815,272

(22) Filed: Aug. 26, 2024

(65) Prior Publication Data

US 2025/0065241 A1 Feb. 27, 2025

Related U.S. Application Data

(60) Provisional application No. 63/534,726, filed on Aug. 25, 2023.

(51) Int. Cl.
*A63H 29/22* (2006.01)
*A63H 29/24* (2006.01)
*A63H 31/00* (2006.01)

(52) U.S. Cl.
CPC ..... *A63H 29/22* (2013.01); *A63H 29/24* (2013.01); *A63H 31/00* (2013.01)

(58) Field of Classification Search
CPC ..... A63H 17/00; A63H 17/26; A63H 17/262; A63H 17/36; A63H 29/00; A63H 29/22; A63H 29/24
See application file for complete search history.

(56) References Cited

U.S. PATENT DOCUMENTS 3,659,378 A * 5/1972 Tong ..... A63H 17/26 446/443
3,939,605 A * 2/1976 Allen ..... A63H 17/26 446/448
7,883,099 B2 * 2/2011 Byers ..... B60G 15/067 280/124.135
8,096,913 B2 * 1/2012 Allmendinger ..... F16H 48/30 475/231
9,387,411 B1 * 7/2016 Thompson ..... A63H 17/262
9,579,584 B2 * 2/2017 Wernimont ..... B60K 17/35
10,413,838 B2 * 9/2019 Chu ..... A63H 17/264
(Continued)

*Primary Examiner* — Kurt Fernstrom
(74) *Attorney, Agent, or Firm* — Daryl R. Wright; Greg Carr

(57) ABSTRACT

A radio-controlled model vehicle is provided including a model vehicle chassis, a vertically mounted motor, and a rear axle, configured to pivot in a vertical direction relative to the model vehicle chassis via one or more rear axle linkages. The rear axle also includes a vertical rear axle differential. The model vehicle further includes a gear reduction transmission including a spur gear comprising spur gear teeth offset from a spur gear center portion, and a pinion gear engaged with the spur gear teeth. In addition, the model vehicle includes a vertical, extendable driveshaft that has one end attached to the spur gear center portion and another end attached to the rear axle differential. Wherein the driveshaft extends through the spur gear and the motor powers propulsion wheels coupled to the rear axle via the gear reduction transmission, driveshaft and rear axle differential.

8 Claims, 10 Drawing Sheets

(56) References Cited

U.S. PATENT DOCUMENTS

| | | | | |
|---|---|---|---|---|
| 11,207,975 | B2 * | 12/2021 | Wood | B60B 35/122 |
| 2006/0228986 | A1 * | 10/2006 | Byers | A63H 31/00 180/383 |
| 2024/0207749 | A1 * | 6/2024 | Christensen | A63H 17/262 |

* cited by examiner

MODEL VEHICLE VERTICAL DRIVE SYSTEM

RELATED APPLICATIONS

This application claims the benefit of a related U.S. Provisional Application Ser. No. 63/534,726, filed Aug. 25, 2023, entitled "MODEL VEHICLE VERTICAL DRIVE SYSTEM," to Trent COLLINS, et al., the disclosure of which is incorporated by reference herein in its entirety.

BACKGROUND

The following descriptions and examples are not admitted to be prior art by virtue of their inclusion in this section.

Radio-Controlled or RC model vehicles are a popular hobby for a growing segment of the population. In the case of electrically powered vehicles, the ease of operation and the run time of RC model vehicles have increased dramatically as the electronics have become more sophisticated and the batteries more advanced. In addition, a key aspect of RC model vehicles are increasing levels of realism in comparison to a full-sized vehicle they may be based upon. However, scale realism and packaging constraints for the electronics and batteries have resulted in new and novel approaches to addressing issues including torque twist, axle movement, and motor mounting.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with one embodiment, a radio-controlled model vehicle is provided comprising a model vehicle chassis and a vertically oriented motor non-rotatively coupled to the model vehicle chassis. In addition, the model vehicle also comprises a rear axle pivotally coupled to model vehicle chassis in a vertical direction via one or more rear axle linkages, the rear axle including a vertically oriented rear axle differential. Further, the model vehicle includes an extendable driveshaft vertically oriented and rotatively coupling the motor to the rear axle differential and configured to transmit a motor torque from the motor to the rear axle differential. Wherein the motor torque powers propulsion wheels coupled to the rear axle via the driveshaft and rear axle differential.

In accordance with another embodiment, a radio-controlled model vehicle is provided comprising a model vehicle chassis and a vertically oriented motor non-rotatively coupled to the model vehicle chassis. In addition, the model vehicle also comprises a rear axle pivotally coupled to model vehicle chassis in a vertical direction via one or more rear axle linkages and including a vertically oriented rear axle differential. Further, the model vehicle includes an extendable driveshaft vertically oriented and rotatively coupling the motor to the rear axle differential and configured to transmit a motor torque from the motor to the rear axle differential.

Wherein the driveshaft further comprises a driveshaft yoke, slidably coupled along a central axis and fixed in rotation relative to a male shaft and a first and second constant velocity joint located at each end of the driveshaft. And wherein the motor torque powers propulsion wheels coupled to the rear axle via the driveshaft and rear axle differential.

In accordance with still another embodiment, a radio-controlled model vehicle is provided comprising a model vehicle chassis, a vertically oriented motor for generating a motor torque, non-rotatively coupled to the model vehicle chassis, and a rear axle, pivotally coupled to move in a vertical direction, to the model vehicle chassis via one or more rear axle linkages. The rear axle further comprises a vertically oriented rear axle differential. The model vehicle also includes a gear reduction transmission comprising a spur gear comprising spur gear teeth offset from a spur gear center coupling portion and a pinion gear powered by the motor and engaged with the spur gear teeth.

In addition, the model vehicle comprises a vertically oriented extendable driveshaft configured to transmit the motor torque. The driveshaft further includes a first end of the driveshaft coupled via a first constant velocity joint to the spur gear coupling portion and a second end of the driveshaft coupled via a second constant velocity joint to the rear axle differential. Wherein the first end of the driveshaft passes through the spur gear teeth and wherein the motor torque powers propulsion wheels coupled to the rear axle via the gear reduction transmission, driveshaft and rear axle differential.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

In the following specification, numerous specific details are set forth to provide a thorough understanding of embodiments of the present disclosure. However, those skilled in the art will appreciate that the embodiments may be practiced without such specific details. In other instances, well-known elements have been illustrated in schematic or block diagram form in order not to obscure embodiments of the present disclosure in unnecessary detail.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment.

Figure 1A:
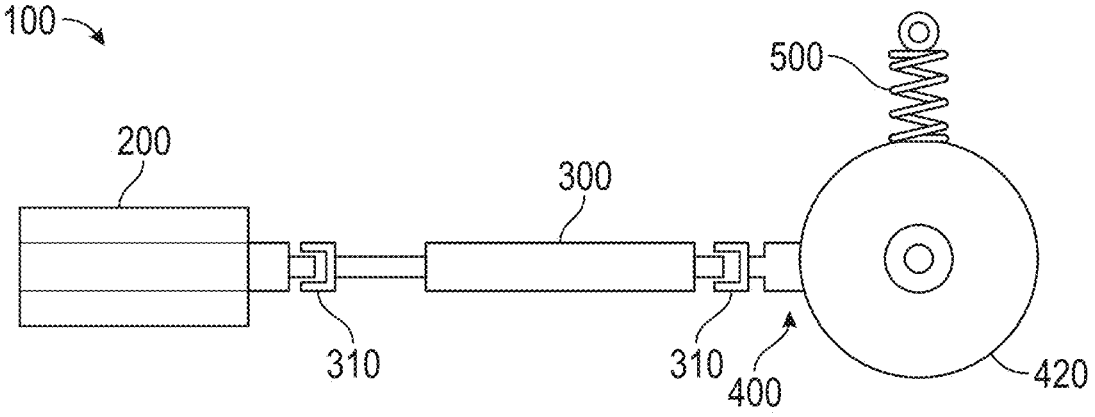
FIG. 1A (Prior Art)
FIG. 1A is a prior art schematic illustration showing a traditional longitudinally mounted front engine, rear wheel drive propulsion system, in a model vehicle.
Figure 1B:
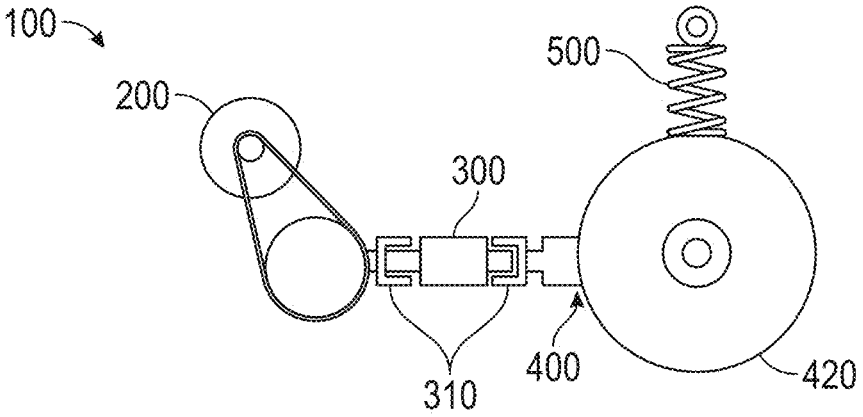
FIG. 1B (Prior Art)
FIG. 1B is a prior art schematic illustration showing a traditional transversely or perpendicular mounted front or rear engine along with corresponding front or rear wheel drive propulsion system, in a model vehicle.
Figure 1C:
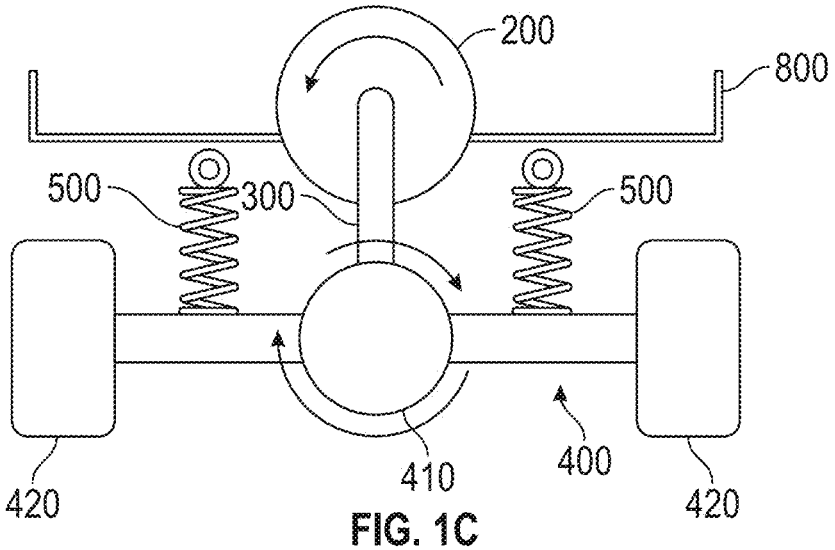
FIG. 1C (Prior Art)
FIG. 1C is a prior art schematic illustration showing a model vehicle body reaction to an engine of FIG. 1A or 1B, applying a starting torque to a model vehicle rear axle, in a model vehicle.

Referring generally to PRIOR ART FIGS. 1A-1C, traditionally the electric motor 200 of an RC model vehicle 100 has been mounted with the rotational axis of the motor 200 either parallel (as in FIG. 1A) or perpendicular (as in FIG. 1B) to a longitudinal centerline (running front to rear) of the RC model vehicle 100. But in either case, the main axis of the motor 200 has been contained in a horizontal plane.

The motor 200 will be mechanically coupled using a propulsion shaft or driveshaft 300 and Constant Velocity Joints (CV Joints) 310 to the propulsion wheels 420 via a rear axle 400 and central differential 410 (See FIG. 1C). In some embodiments, the motor 200 is mechanically coupled to the driveshaft 300 via a transmission (not shown).

The driveshaft 300 is configured to extend and retract (i.e., compress), allowing for movement of the rear axle 400 resulting from suspension 500 (e.g., springs, dampers, linkages, among others) travel. As the RC model vehicle 100 travels over imperfections in a road or pathway, the wheels 420 may travel vertically relative to the RC model vehicle 100, potentially changing the distance between the rear axle 400 and the motor 200.

The driveshaft 300 is further configured to transmit a torque from the motor 200 to the propulsion wheels 420. In some cases, the motor 200 applies a torque to the driveshaft 300 that produces a moment on the center differential 410. The moment results in a counter moment to occur in the body 800 (see FIG. 1C) and rest of the model vehicle structure. The ability of the body 800 to react independent of the rear axle 400 is due to the rear axle's 400 need to vertically travel over road imperfections, such as bumps and potholes.

The suspension 500 dampens and absorbs the relative motion between the rear axle 400 and the model vehicle body 800. The result is a smoother and more stable ride for the rest of the model vehicle 100 and associated electronics (e.g. the motor 200, for example) and better handling for the operator of the model vehicle 100.

When a high-powered motor 200 launches an RC model vehicle 100 from rest, the body 800 may exhibit a large torque-twist or counter moment rotation in reaction to the torque generated from the motor 200. The amount of movement is somewhat controlled through the selection of spring constants and dampening forces provided in the suspension 500. Too much movement may diminish the realism of the operation of a scale RC model vehicle 100. More excessive examples of this torque counter moment may be seen in the launch from stationary of full-sized drag racers and the tractors of semi-trucks pulling a large load.

In one embodiment of the current disclosure, a 1920's dirt track racer 1000 was scaled down and duplicated for an RC model vehicle 1000. As seen generally in FIG. 2, a semi-transparent 1920's model vehicle body 8000 was mounted on a narrow model vehicle chassis 7000 (see FIG. 3). Aspects of the model vehicle 1000 were duplicated as accurately as possible along with many of the period type suspension components, such as leaf springs 5200 and lever shocks 5100 (see FIGS. 3 and 4).

To maintain the scale appearance of the desired model vehicle 1000, all components were required to be tightly packaged in the chassis 7000. There was insufficient space beneath the body 8000 (see FIG. 2) to traditionally mount the motor 2000. However, use of a vertically mounted motor 2000 was permitted. This mounting orientation resulted in a ~53% smaller electronic footprint on the chassis 7000 (see FIG. 3).

One target for this type of RC model vehicle 1000 is a front/rear weight distribution of 40/60. With the motor 2000 being the heaviest component in the vehicle 1000, it is beneficial to have the motor 2000 mounted as rearward as possible in the chassis 7000. The motor 2000 mounted in a traditional setting behind the rear axle 4000 (i.e., a transversely or longitudinally oriented motor mounting) would not be possible due to packaging and the interior configuration of the model vehicle body 8000.

Figure 2:
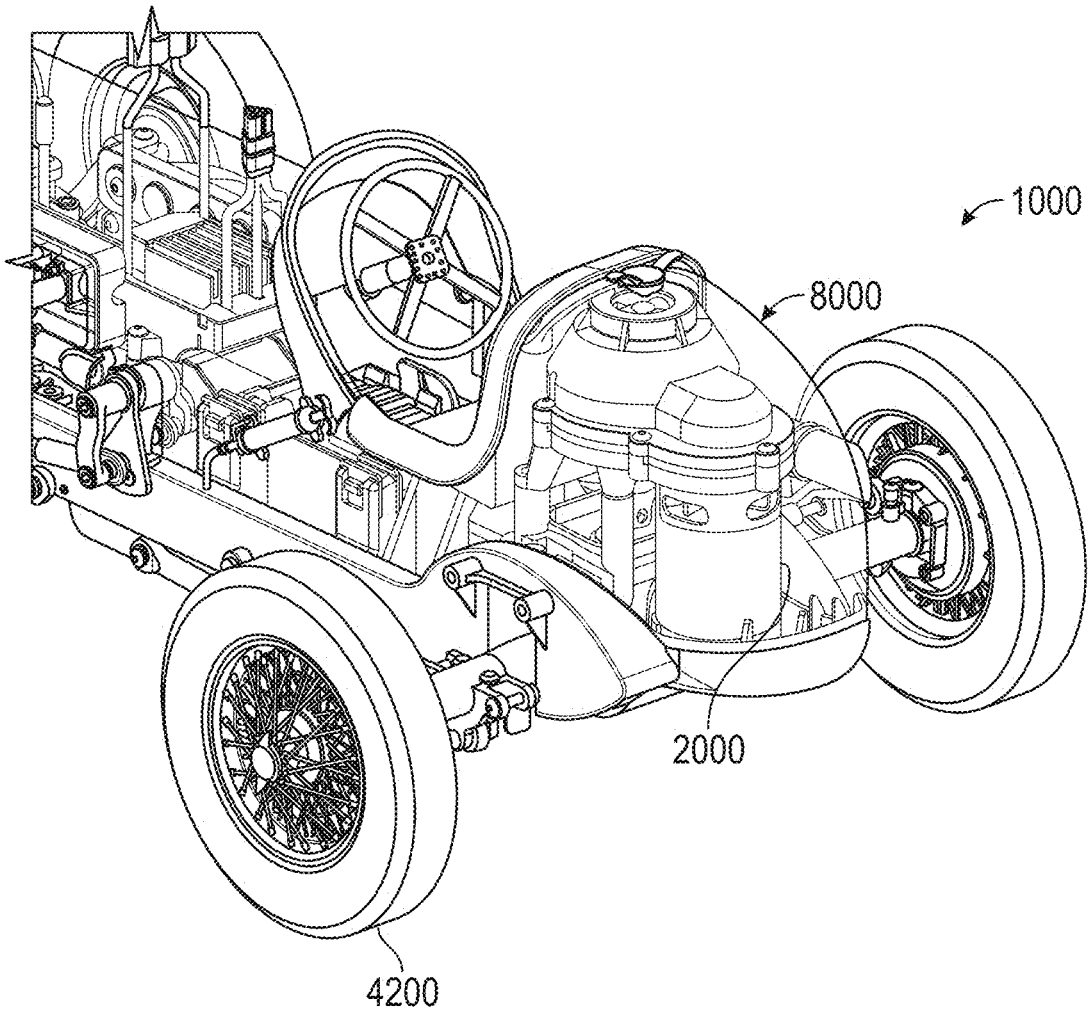
FIG. 2 is an elevated, perspective transparent view of a model vehicle comprising a model vehicle body mounted to a model vehicle chassis, showing a vertically mounted motor in accordance with an embodiment of the current disclosure.

The propulsion wheels 4200 for the period racer are positioned outside of the model vehicle body 8000. Accordingly, the electronics, control servos and battery power had to be packaged within a relatively narrow body configuration broken up by an exposed, open, cockpit. As seen in FIG. 2, the unusual (as compared to more common and traditional RC model vehicles) the model vehicle body 8000 and model vehicle chassis 7000 design resulted in the vertical orientation of the main axis 2100 (see FIGS. 10A and 10B) of the motor 2000. The vertical mounting addresses space constraints and weight distribution goals caused by the unusual model vehicle body 8000 and model vehicle chassis 7000.

Traditional parallel or perpendicular mounting of the motor 2000 and motor axis 2100, such as in the prior art examples, may have resulted in an increase in the level of torque twist or counter moment reaction due to the use of a solid rear axle suspension 5000 in the model vehicle 1000, and the earlier technology and configuration of leaf springs 5200 and lever shocks 5100. In this exemplary embodiment, the vertically oriented motor 2000 was positioned behind the open cockpit, as easily seen in FIG. 2.

Figure 3:
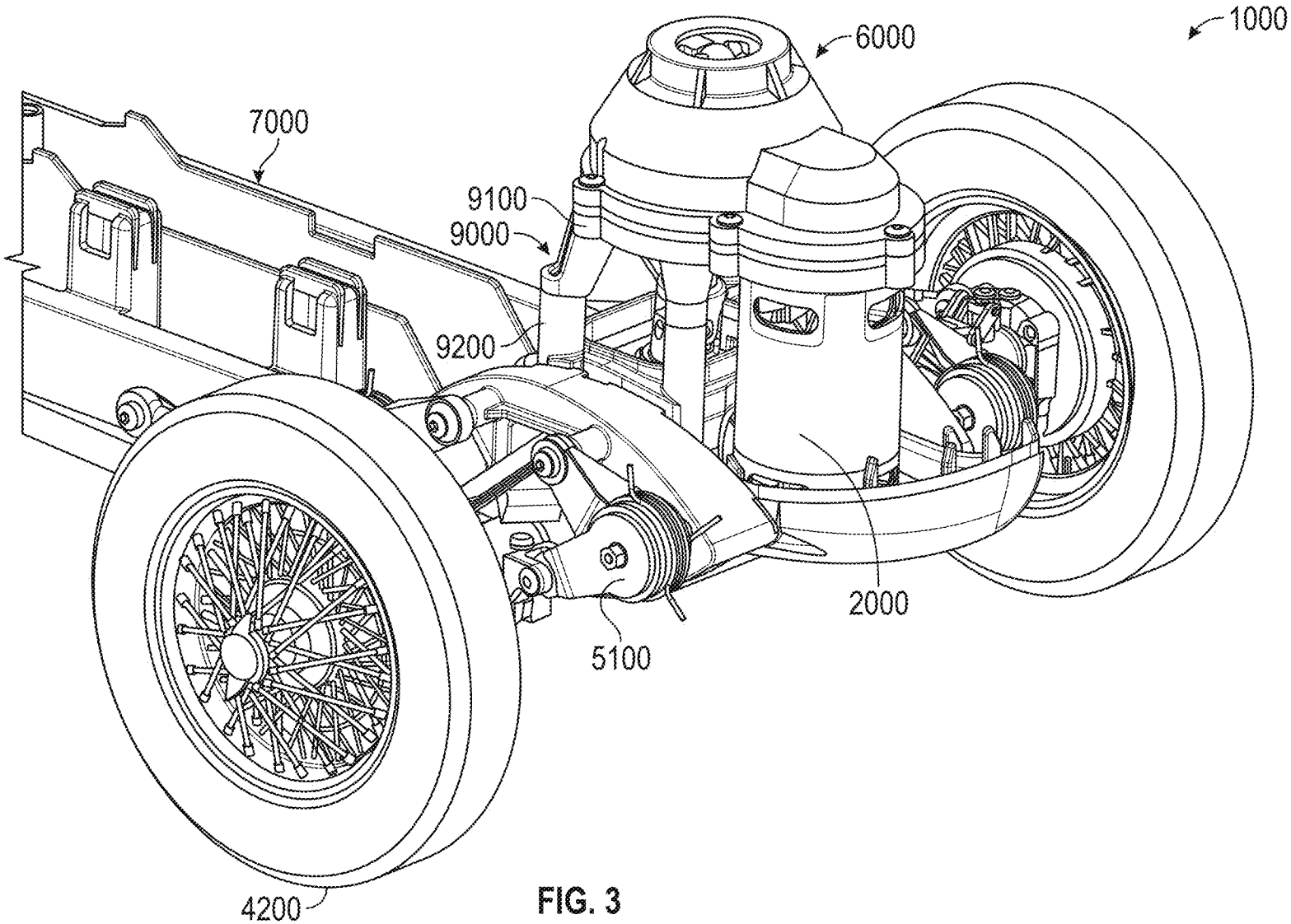
FIG. 3 is an elevated, perspective view of the model vehicle chassis of FIG. 2 with the model vehicle body removed, showing a vertically mounted motor, motor mount, and transmission assembly in accordance with an embodiment of the current disclosure.
Figure 5:
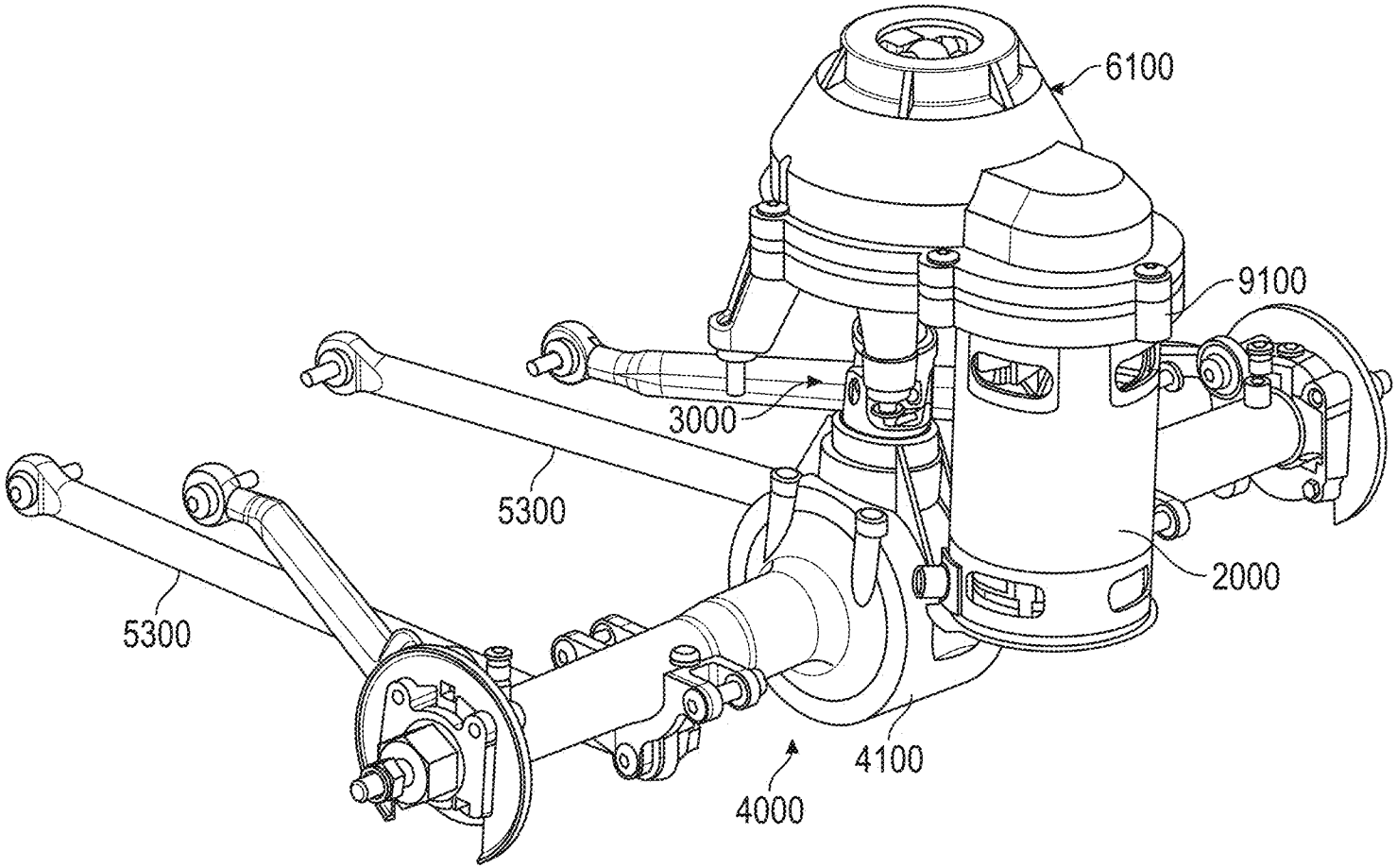
FIG. 5 is an elevated, perspective view of the model vehicle of FIG. 3 with the chassis removed, showing the rear axle and axle linkages together with the motor and transmission in accordance with an embodiment of the current disclosure.
Figure 6:
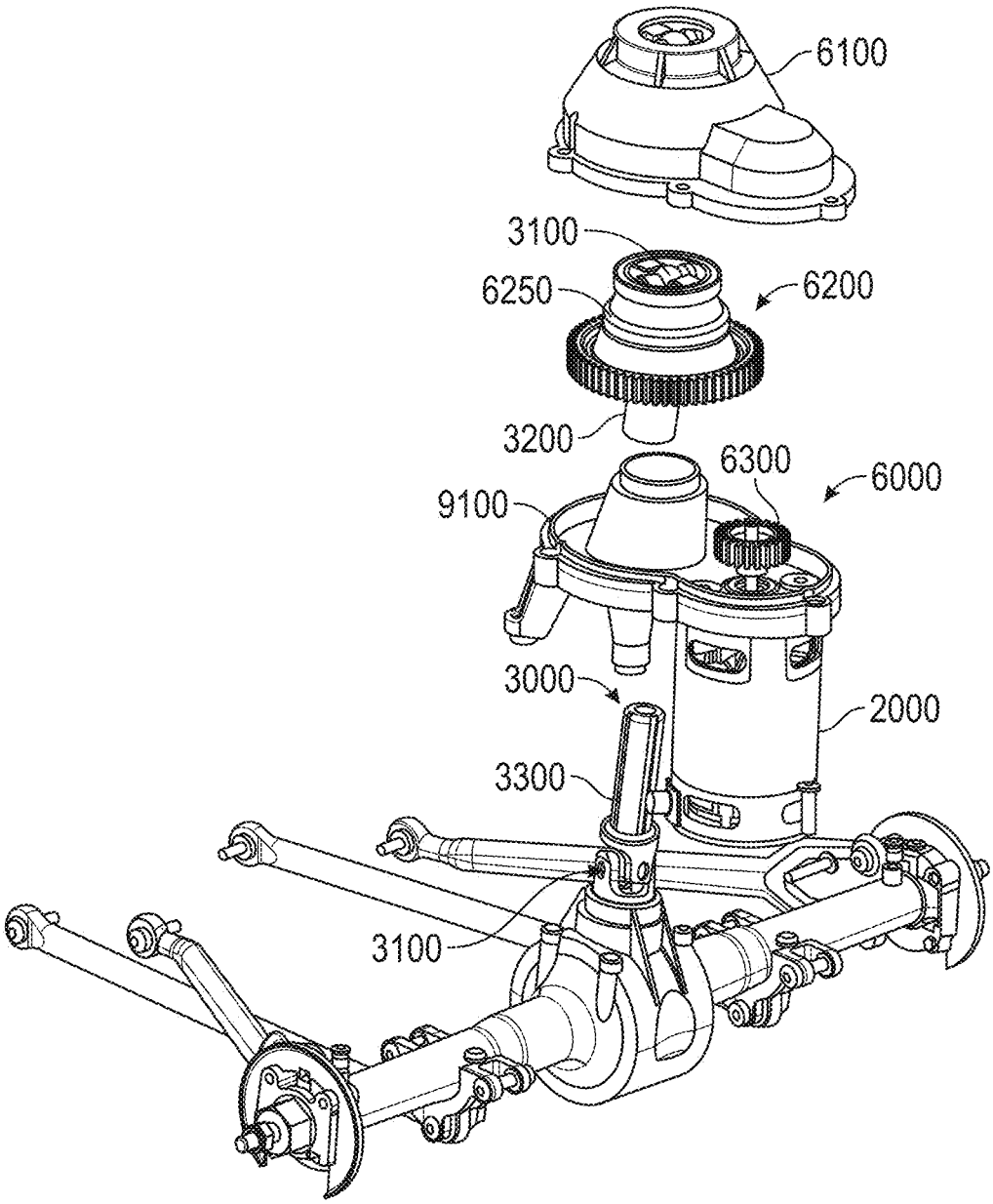
FIG. 6 is an exploded, perspective view of the model vehicle of FIG. 5 showing the pinon and spur gears, and driveshaft yoke and male shaft in accordance with an embodiment of the current disclosure.

As seen more clearly in FIG. 3, the vehicle motor 2000 is coupled to a transmission 6000 (shown in this exemplary embodiment as a direct, gear reduction drive involving a pinion 6300 and ring or spur gear 6200 (shown in FIG. 6), but in still other embodiments may comprise multiple gear ratios, reverse, or combinations thereof). In other embodiments, the motor 2000 may be directly coupled to the driveshaft 3000 (most easily seen in FIG. 6) via the upper and lower Constant Velocity or Universal joints 3100 (CV Joints, U-joints, see FIGS. 5 and 6).

The vertical packaging of components in a space restricted chassis 7000 behind the cockpit, resulted the motor 2000 mounted at the rear of the model vehicle 1000. The motor 2000 at the rear of the model vehicle 1000 and a battery and other electronics (not shown) mounted in the front of the model vehicle 1000, provided an optimized weight distribution for improved overall handling.

Figure 8:
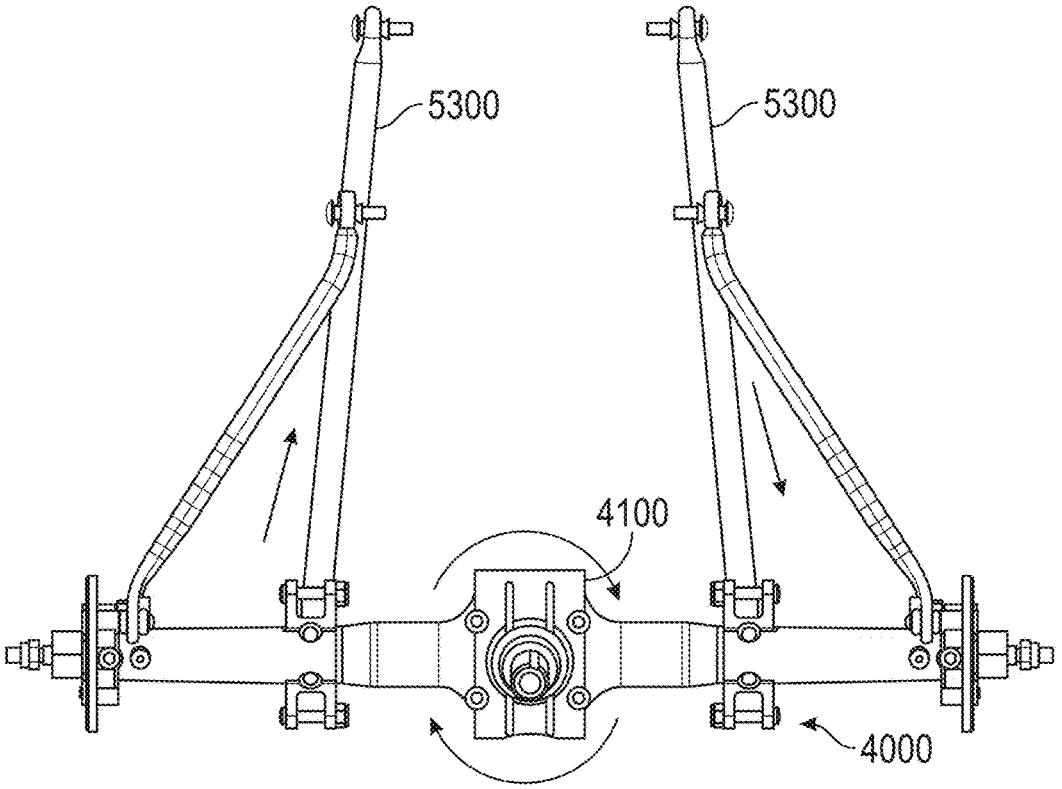
FIG. 8 is a top-down view of the rear axle and axle linkages of the model vehicle of FIG. 3 showing how the torque reaction effects resulting from the torque applied to the differential are constrained by the rear axle linkages of the coupling the rear axle to the model vehicle chassis (not shown), according to an embodiment of the current disclosure.

Torque twist or counter moment reaction, was addressed through the use of the vertical motor 2000 mounting. As shown in the top-down view of FIG. 8, the torque twist or counter moment reaction is contained within a horizontal plane, rather than in a vertical plane as shown in FIG. 1C, which is perpendicular to the travel direction of the rear axle 4000 relative to the model vehicle chassis 7000 and body 8000. Vertical mounting of the driveshaft 3000 allows the axle input gear or differential 4100 to also be orientated vertically (see also, FIGS. 5, 6, 10A, 10B).

By having the propulsion components orientated vertically, the torque-twist or counter moment reaction due to driveshaft rotation is transmitted horizontally, perpendicular to the rear axle 4000 direction of vertical travel. Accordingly, the torque-twist or counter moment reaction is directed into the suspension's rear axle linkages 5300, instead of the suspension's 5000 shocks 5100 or springs 5200. This mounting substantially reduces and inhibits any visible torque twist reaction in the model vehicle body 8000 through the suspension 5000 relative to the model vehicle rear axle 4000.

Figure 4:
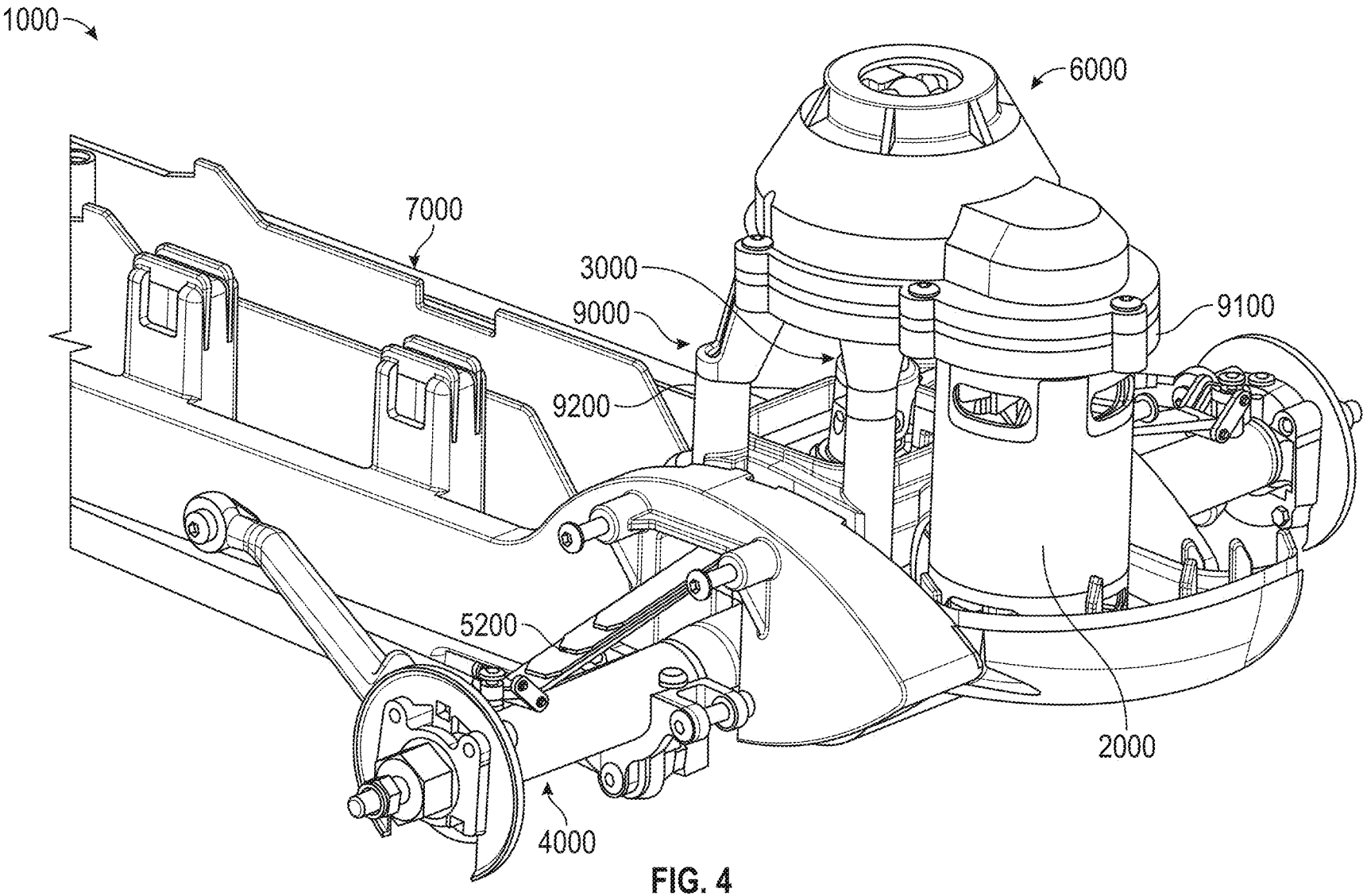
FIG. 4 is an elevated, perspective view of the model vehicle chassis of FIG. 3 with the lever shocks and wheels removed, showing a transversely mounted leaf spring in accordance with an embodiment of the current disclosure.

The motor 2000 is secured to the chassis 7000 through the motor mounting assembly 9000 (see FIG. 4). The motor mounting assembly 9000 comprises the motor plate 9100 and the motor mounting tower 9200. The motor plate 9100 has a bearing surface to support the pinion gear 6300 and another bearing surface to support the spur gear 6200. In addition, the gear cover 6100 has a bearing surface to support the spur gear coupling portion 6250 via bearing 6150 (see FIGS. 5-7, 10A, and 10B). The motor plate 9100 is mounted to the chassis 7000 through the motor mounting tower 9200 (see FIG. 3).

Figure 10A:
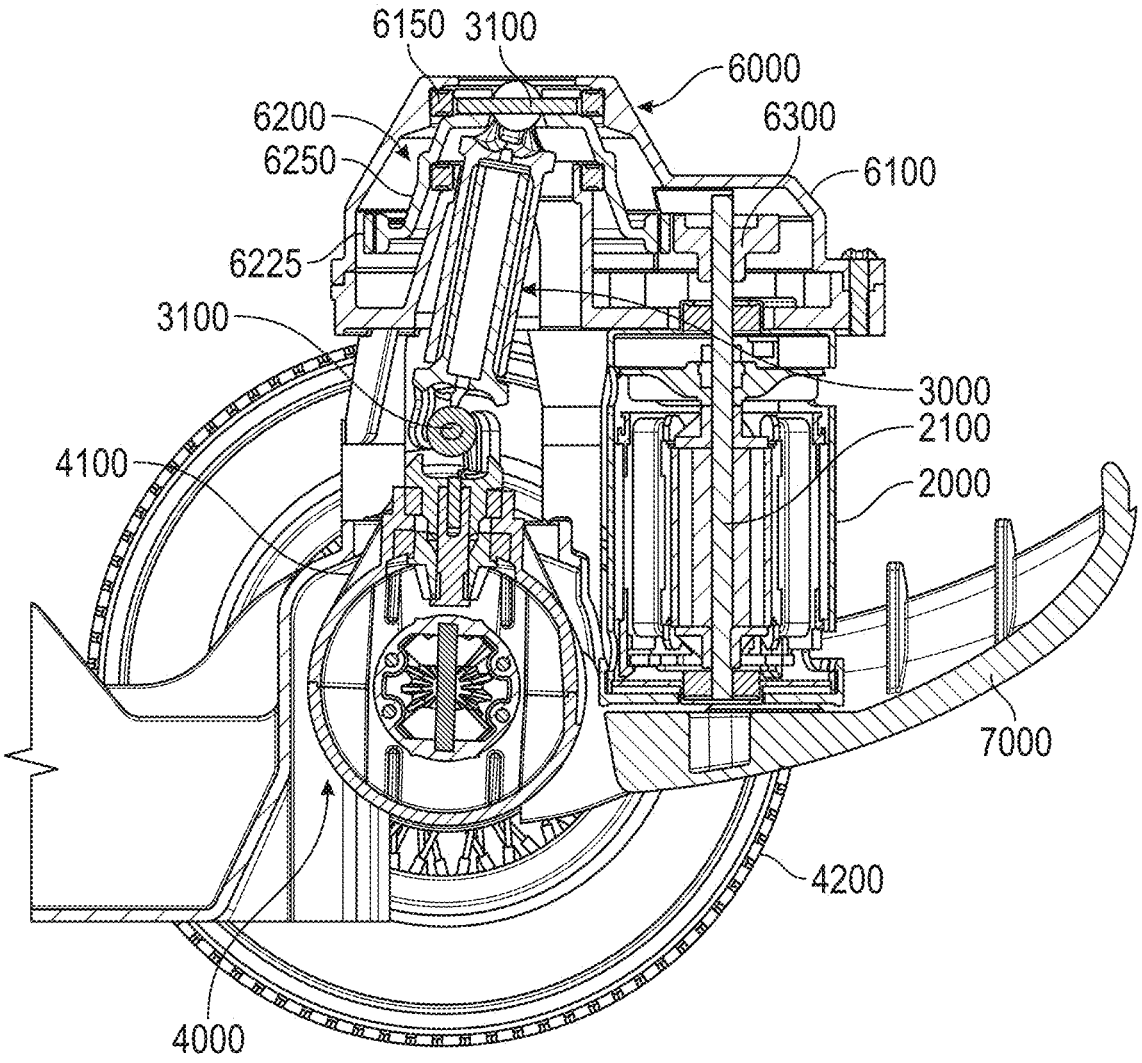
FIG. 10A is a partial cut-away of a portion of the model vehicle of FIG. 3 in which the rear axle is at an upper vertical limit in travel relative to the rest of the model vehicle chassis, according to an embodiment of the current disclosure.
Figure 10B:
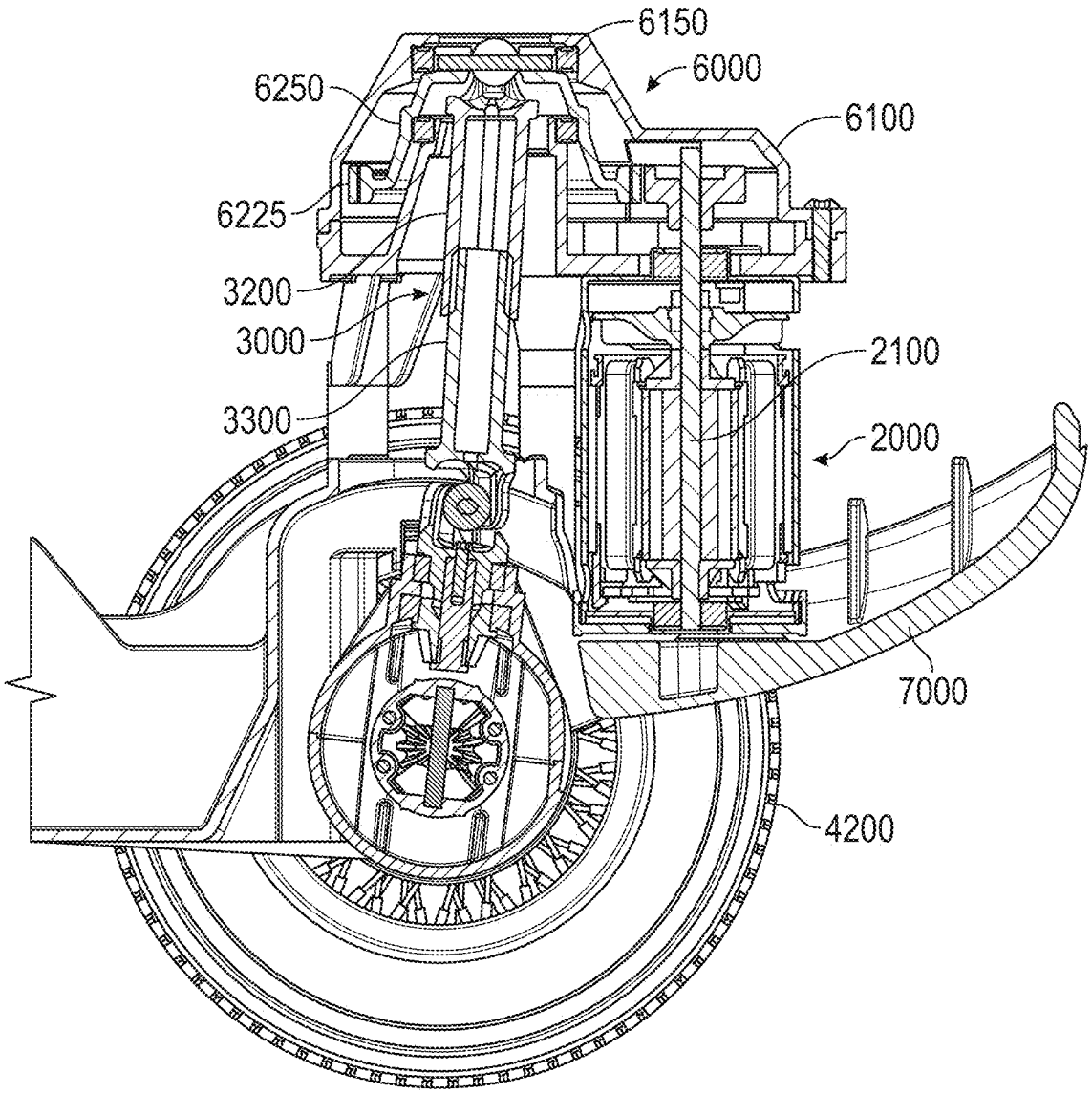
FIG. 10B is a partial cut-away of a portion of the model vehicle of FIG. 10A in which the rear axle is at a lower vertical limit in travel relative to the rest of the model vehicle chassis, according to an embodiment of the current disclosure.

Referring to FIGS. 10A and 10B, vertically mounting the driveshaft above the axle 4000 causes any vertical movement of the axle 4000 to result in the same amount of driveshaft plunge or travel (e.g., compression when going over bumps, droop or extension when encountering potholes). In a traditionally configured suspension vehicle, the amount of driveshaft travel is relatively much less than the wheel travel, due to the vertical wheel travel translating into an angled compression or expansion of the drive shaft (see FIGS. 1A-1C). This issue is accommodated by designing the driveshaft 3000 to be as long as possible while still being within the limits of the interior of the model vehicle body 8000.

Figure 9:
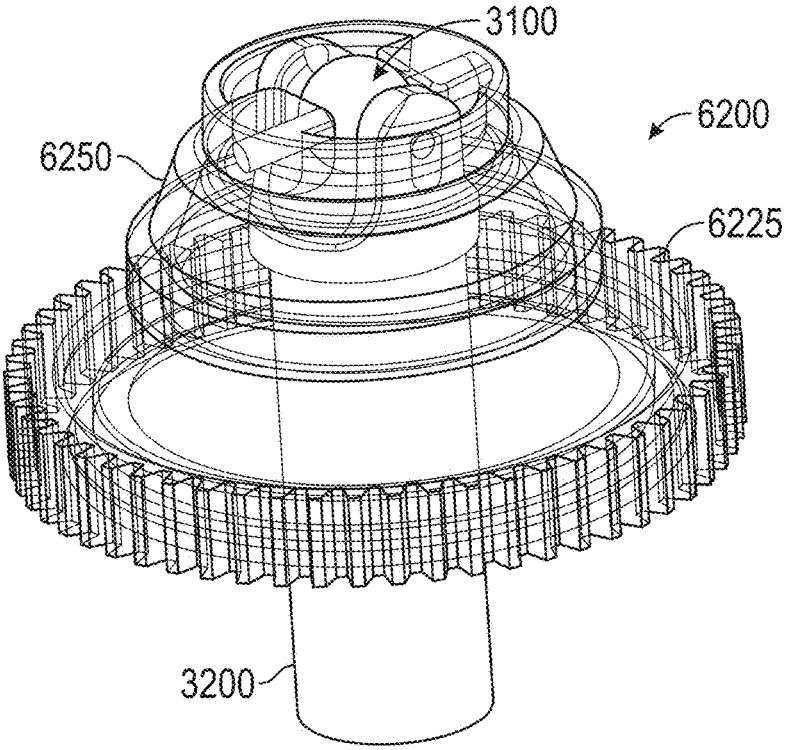
FIG. 9 is a semi-transparent view of the spur gear and the constant velocity joint coupling with one end of the driveshaft york in which a pin securing the constant velocity joint is constrained by an upper bearing, according to an embodiment of the current disclosure.

Additional lengths for the driveshaft 3000 were facilitated by having the driveshaft 3000 pass through the spur gear teeth 6225 (see FIG. 9) and engage with the spur gear coupling portion 6250 via one of the constant velocity joints 3100. As seen in FIGS. 9 and 10A, the pins for the constant velocity joint 3100 are constrained by the bearing 6150, preventing their inadvertent loss or loosening via rough operation of the motor vehicle.

Figure 7:
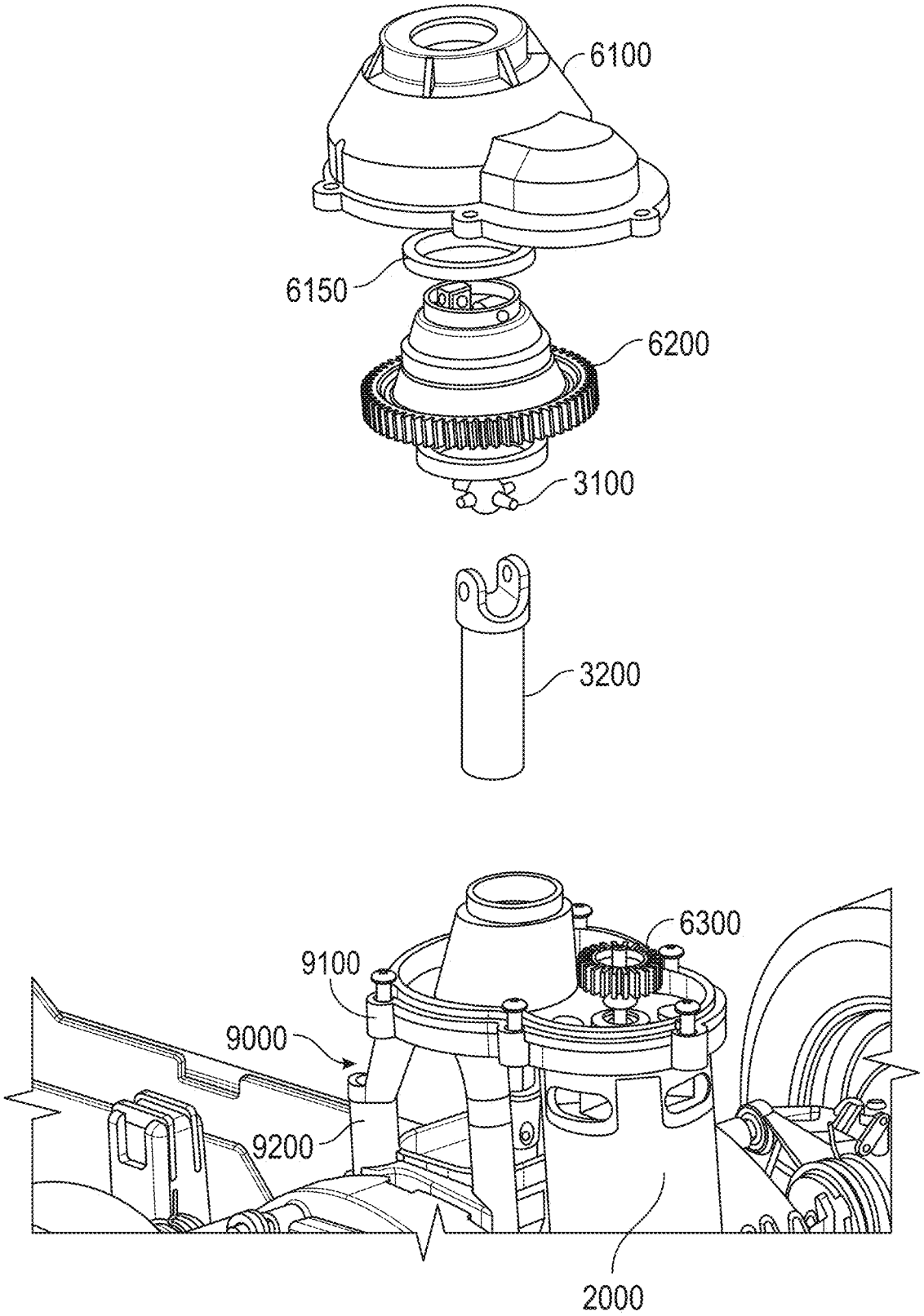
FIG. 7 is an enlarged perspective view of the model vehicle of FIG. 6 showing an upper exploded view comprising the pinon and spur gears, constant velocity joint, motor mount, and driveshaft yoke in accordance with an embodiment of the current disclosure.

To lengthen the driveshaft sufficiently to allow for the required driveshaft 3000 expansion and contraction or plunge, the embodiment shown incorporates one end of the driveshaft yoke 3200 passing through the spur gear teeth 6225 (see FIGS. 7 and 9). This configuration allows the saving of vertical room with a reduction in parts. The driveshaft yoke 3200 passes through the spur gear teeth 6225 where it assembles with the male shaft 3300 coupled to the rear axle 4000 via another of the constant velocity joints 3100. In some embodiments and depending upon the scale, this design may allow approximately 500 mm in overall driveshaft 3000 length and up to 21 mm of driveshaft plunge or travel for example in an approximately 1/7th scale, 1920's dirt track racer (see FIGS. 10A and 10B).

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few example embodiments have been described in detail above, those skilled in the art will readily appreciate that a wide range of variations, modifications, changes, and substitutions are contemplated in the foregoing disclosure and, in some instances, some features of the present disclosure may be employed without a corresponding use of the other features It is the express intention of the applicant not to invoke 35 U.S.C. § 112, paragraph 6 for any limitations of any of the claims herein, except for those in which the claim expressly uses the words 'means for' together with an associated function.

What is claimed is:

1. A radio-controlled model vehicle comprising:

a model vehicle chassis;

a vertically oriented motor non-rotatively coupled to the model vehicle chassis;

a rear axle pivotally coupled to model vehicle chassis in a vertical direction via one or more rear axle linkages, and comprising:

a vertically oriented rear axle differential;

an extendable driveshaft vertically oriented and rotatively coupling the motor to the rear axle differential and configured to transmit a motor torque from the motor to the rear axle differential;

wherein the motor torque powers propulsion wheels coupled to the rear axle via the driveshaft and rear axle differential.

2. The radio-controlled model vehicle claimed in claim 1, wherein the extendable driveshaft further comprises:

a driveshaft yoke, slidably coupled along a central axis and fixed in rotation relative to a driveshaft male shaft; and a first and second constant velocity joint located at each end of the driveshaft;

wherein the first end of the driveshaft is coupled to the motor via the first constant velocity joint; and wherein the second end of the driveshaft is coupled to the rear axle differential via the second constant velocity joint.

3. The radio-controlled model vehicle claimed in claim 1, wherein the motor is coupled to the model vehicle chassis via a motor mounting assembly.

4. The radio-controlled model vehicle claimed in claim 3, wherein the motor mounting assembly further comprises:

a motor plate mounted to the motor; and a motor mounting tower coupling the motor plate and the model vehicle chassis.

5. A radio-controlled model vehicle comprising:

a model vehicle chassis;

a vertically oriented motor non-rotatively coupled to the model vehicle chassis;

a rear axle pivotally coupled to model vehicle chassis in a vertical direction via one or more rear axle linkages, and comprising:

a vertically oriented rear axle differential;

an extendable driveshaft vertically oriented and rotatively coupling the motor to the rear axle differential and configured to transmit a motor torque from the motor to the rear axle differential, wherein the driveshaft further comprises:

a driveshaft yoke, slidably coupled along a central axis and fixed in rotation relative to a driveshaft male shaft; and a first constant velocity joint located at a first end of the driveshaft and coupled to the motor;

a second constant velocity joint located at a second end of the driveshaft and coupled to the rear axle differential; and wherein the motor torque powers propulsion wheels coupled to the rear axle via the driveshaft and rear axle differential.

6. The radio-controlled model vehicle claimed in claim 5, further comprising:

a gear reduction transmission comprising:

a spur gear comprising spur gear teeth offset from a spur gear center coupling portion; and a pinion gear powered by the motor and engaged with the spur gear teeth;

wherein the first end of the driveshaft is coupled to the motor via the spur gear center coupling portion and the first constant velocity joint; and wherein the first end of the driveshaft passes through the spur gear teeth;

wherein the motor torque powers propulsion wheels coupled to the rear axle via the gear reduction transmission, driveshaft and rear axle differential.

7. A radio-controlled model vehicle comprising:

a model vehicle chassis;

a vertically oriented motor for generating a motor torque, non-rotatively coupled to the model vehicle chassis;

a rear axle, pivotally coupled to move in a vertical direction, to the model vehicle chassis via one or more rear axle linkages, and comprising:

a vertically oriented rear axle differential;

a gear reduction transmission comprising:

a spur gear comprising spur gear teeth offset from a spur gear center coupling portion; and a pinion gear powered by the motor and engaged with the spur gear teeth;

a vertically oriented extendable driveshaft configured to transmit the motor torque and comprising:

a first end of the driveshaft coupled via a first constant velocity joint to the spur gear center coupling portion;

a second end of the driveshaft coupled via a second constant velocity joint to the rear axle differential; and wherein the first end of the driveshaft passes through the spur gear teeth;

wherein the motor torque powers propulsion wheels coupled to the rear axle via the gear reduction transmission, driveshaft and rear axle differential.

8. The radio-controlled model vehicle claimed in claim 7, wherein the extendable driveshaft further comprises:

a driveshaft yoke, slidably coupled along a central axis and fixed in rotation relative to a driveshaft male shaft.

* * * * *